US009466441B2

(12) United States Patent
Jurek et al.

(10) Patent No.: US 9,466,441 B2
(45) Date of Patent: Oct. 11, 2016

(54) TRIP BAR STOP

(71) Applicant: Eaton Corporation, Cleveland, OH (US)

(72) Inventors: Raymond Lee Jurek, Pittsburgh, PA (US); David Curtis Turner, Imperial, PA (US); Jack Edward Devine, Pittsburgh, PA (US); Bradley Patrick Rizzo, Bethel Park, PA (US); Brian Scott Jansto, Beaver Falls, PA (US)

(73) Assignee: EATON CORPORATION, Cleveland, OH (US)

( * ) Notice: Subject to any disclaimer, the term of this patent is extended or adjusted under 35 U.S.C. 154(b) by 183 days.

(21) Appl. No.: 14/452,577

(22) Filed: Aug. 6, 2014

(65) Prior Publication Data

US 2016/0042884 A1 Feb. 11, 2016

(51) Int. Cl.

| | |
|---|---|
| ***H01H 9/20*** | (2006.01) |
| ***H01H 71/50*** | (2006.01) |
| ***H01H 3/20*** | (2006.01) |
| ***H01H 3/46*** | (2006.01) |
| ***H01H 3/52*** | (2006.01) |
| *H01H 71/52* | (2006.01) |

(52) U.S. Cl.

CPC ..... *H01H 9/20* (2013.01); *H01H 3/20* (2013.01); *H01H 3/46* (2013.01); *H01H 3/52* (2013.01); *H01H 71/504* (2013.01); *H01H 71/505* (2013.01); *H01H 71/522* (2013.01)

(58) Field of Classification Search

CPC ..... H01H 71/504; H01H 2300/024; H01H 9/20; H01H 9/286

USPC ..... 200/401, 43.14–43.16, 43.19

See application file for complete search history.

(56) References Cited

U.S. PATENT DOCUMENTS

| | | | |
|---|---|---|---|
| 4,144,427 | A | 3/1979 | Gryctko et al. |
| 4,679,018 | A | 7/1987 | McKee et al. |

FOREIGN PATENT DOCUMENTS

| | | | |
|---|---|---|---|
| DE | 102 09 262 | C1 | 12/2003 |
| DE | 10 2007 018848 | A1 | 11/2007 |
| FR | 2 071 256 | A5 | 9/1971 |

OTHER PUBLICATIONS

European Patent Office, "extended European search report" (for corresponding application EP 15 179 991.3), Jan. 5, 2016, 12 pp.

*Primary Examiner* — Renee Luebke
*Assistant Examiner* — Ahmed Saeed
(74) *Attorney, Agent, or Firm* — Eckert Seamans Cherin & Mellott, LLC; David C. Jenkins; Grant E. Coffield

(57) ABSTRACT

An operating mechanism including a number of biasing elements and a number of linkage members is provided. The linkage members are operatively coupled to each other and each are movable between a second configuration, an initial tripped configuration, a rebound configuration, and a final tripped configuration. The biasing elements are operatively coupled to the number of linkage members and bias the number of linkage members to the final, first configuration. A stop member is coupled to one of the linkage members. The stop member moves with the associated linkage member. The stop member is positioned to contact a stop surface when the linkage members are in the rebound configuration. Contact between the stop member and the stop surface substantially arrests the motion of the linkage members.

12 Claims, 9 Drawing Sheets

TRIP BAR STOP

BACKGROUND OF THE INVENTION

1. Field of the Invention

The disclosed and claimed concept relates to a circuit breaker and, more specifically, to a circuit breaker operating mechanism that is structured to resist rebounding from an open, first configuration to a closed, second configuration.

2. Background Information

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers are well known in the art. Circuit breakers are used to protect electrical circuitry from damage due to an over-current condition, such as an overload condition or a relatively high level short circuit or fault condition. Circuit breakers typically include a number of pairs of separable contacts, an operating mechanism, and a trip unit. The separable contacts move between on open, first configuration and a closed, second configuration. The separable contacts may be operated either manually by way of a handle disposed on the outside of the case or automatically in response to an over-current condition.

That is, the operating mechanism is designed to rapidly open and close the separable contacts. In an exemplary embodiment, the operating mechanism includes a number of linkage members and biasing elements. The linkage members move between an open, first configuration and a closed, second configuration (which correspond to the configuration of the contacts). The biasing elements bias the linkage members, and therefore the operating mechanism and contacts, to the first open configuration. The operating mechanism is structured to be latched and thereby maintain the contacts in a closed, second configuration. The trip unit is structured to detect over-current conditions. When an over-current condition is detected, the trip unit, and in an exemplary embodiment, a trip bar releases the operating mechanism latch thereby allowing the biasing elements to bias the linkage members, and therefore the operating mechanism and contacts, to the first open configuration. After such an event, and in an exemplary embodiment, the operating mechanism, as well as the trip unit, are moved into a reset configuration wherein elements are positioned and the biasing elements charged in preparation for returning to the second configuration.

A disadvantage of such circuit breakers is that the elements of the operating mechanism and the trip assembly move so rapidly that, upon reaching the first configuration, momentum and elastic forces cause certain elements to rebound, that is, bounce back toward the second configuration. The rebound motion can position various elements in a configuration that interfere with the reset configuration. There is, therefore, a need for an operating mechanism for a circuit breaker that substantially arrests the reverse motion of the linkage members after an over-current event. There is a further need for a such an operating mechanism to be incorporated into existing circuit breakers.

SUMMARY OF THE INVENTION

These needs, and others, are met by at least one embodiment of this invention which provides for an operating mechanism including a number of biasing elements and a number of linkage members. The linkage members are operatively coupled to each other and each are movable between a second configuration, an initial tripped configuration, a rebound configuration, and a final tripped configuration. The biasing elements are operatively coupled to the number of linkage members and bias the number of linkage members to the final, first configuration. A stop member is coupled to one of the linkage members. The stop member moves with the associated linkage member. The stop member is positioned to contact a stop surface when the linkage members are in the rebound configuration. Contact between the stop member and the stop surface substantially arrests the motion of the linkage members.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
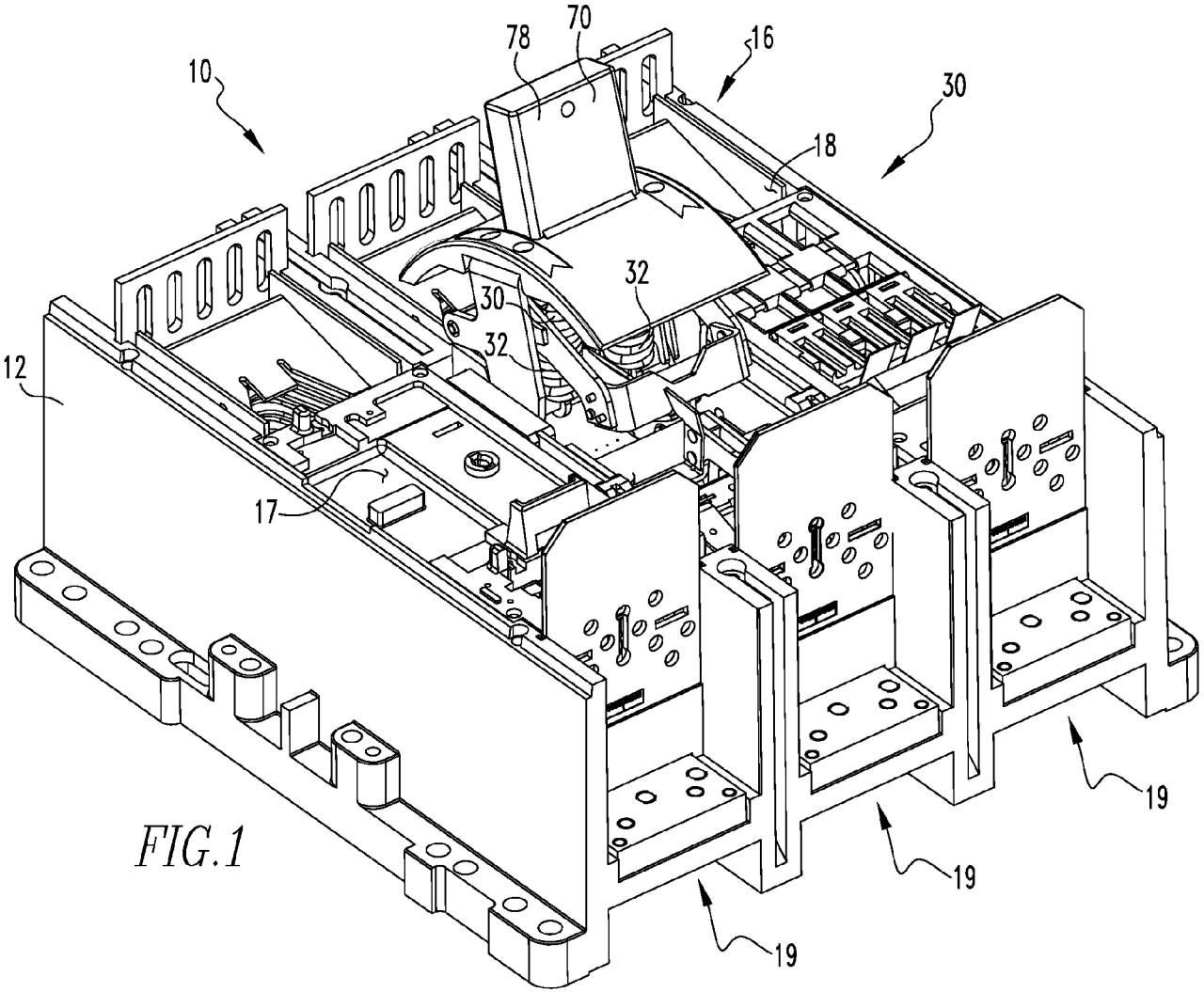
FIG. 1 is an isometric view of a circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one configuration to another and/or may "engage" another element once in the described configuration. Thus, it is understood that the statements, "when element A moves to element A first configuration, element A engages element B," and "when element A is in element A first configuration, element A engages element B" are equivalent statements and mean that element A either engages element B while moving to element A first configuration and/or element A either engages element B while in element A first configuration.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver operatively engages the screw and causes the screw to rotate.

As used herein, "operatively coupled" means that a number of elements or assemblies, each of which is movable between a first position and a second position (or another position), or a first configuration and a second configuration (or another configuration), are coupled so that as the first element moves from one position/configuration to the other, the second element moves between position/configuration as well. It is noted that a first element may be "operatively coupled" to another without the opposite being true.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "planar body" or "planar member" is a generally thin element including opposed, wide, generally flat surfaces as well as a thinner edge surface extending between the wide flat surfaces. The edge surface may include generally flat portions, e.g. as on a rectangular planar member, or be curved, as on a disk, or have any other shape.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "correspond," when used in conjunction with a description of an element's shape or size, indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As shown in FIG. 1, and as is known, a circuit breaker 10 includes a housing assembly 12, a conductor assembly 14, an operating mechanism 16, a trip unit assembly 40, (some elements shown schematically or in part) as well as other components. The housing assembly 12 is made from a non-conductive material and defines an enclosed space 18 wherein the other components may be disposed. The housing assembly enclosed space 18 is, in an exemplary embodiment, divided into a number of cavities 17 including, or which may also be identified as, a number of elongated channels 19 and a trip unit cavity (not shown). The housing assembly 12, in an exemplary embodiment, includes a number of metal support members 13. Such housing assembly support members 13 may act as mounting or coupling locations, including but not limited to rotatable coupling locations, for various elements of the circuit breaker 10.

Figure 2:
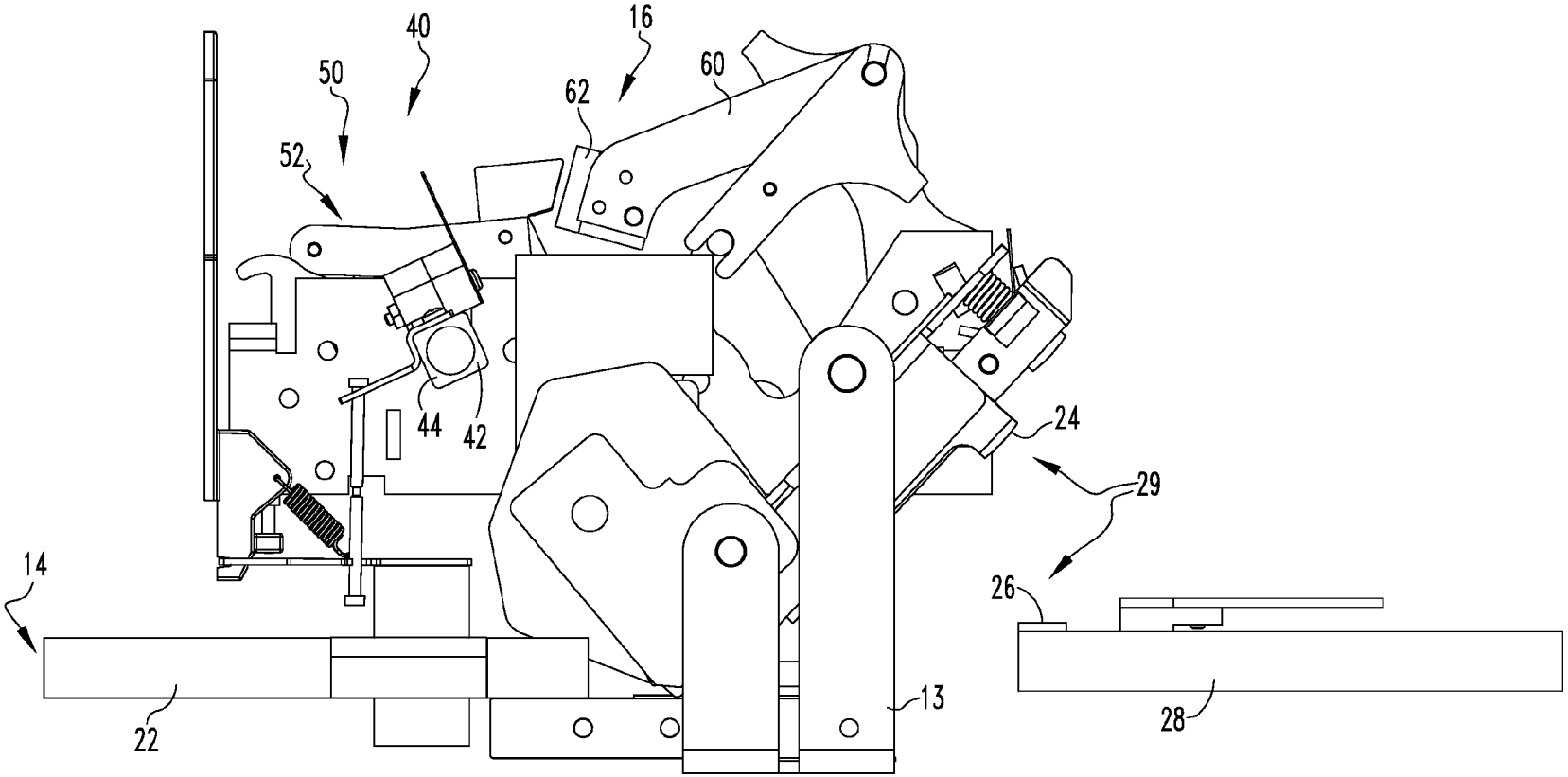
FIG. 2 is a partial side view of the circuit breaker with the contacts in a first, open configuration.
Figure 3:
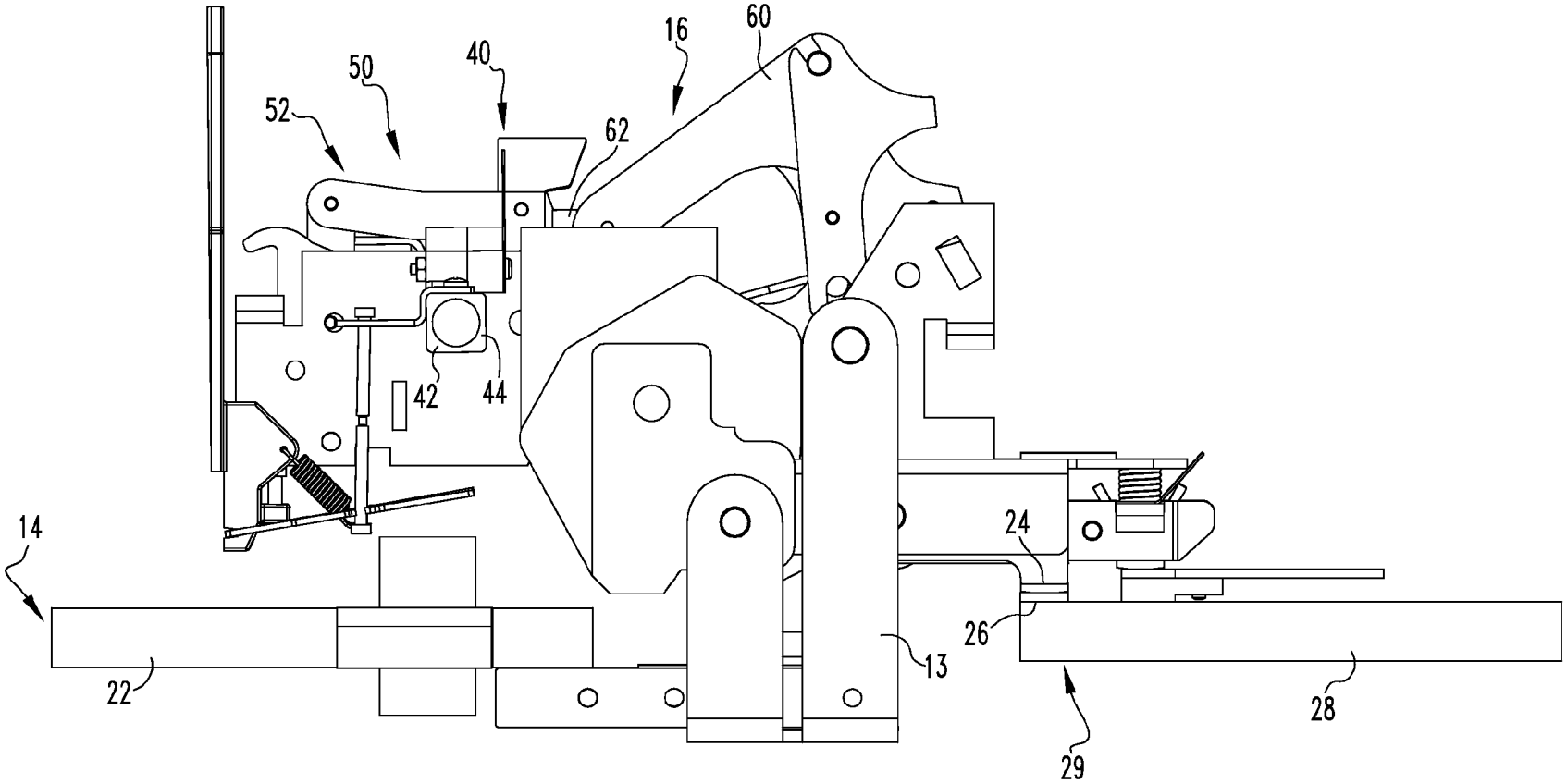
FIG. 3 is a partial side view of the circuit breaker with the contacts in a second, closed configuration.

That is, as shown in FIGS. 2 and 3, each conductor assembly 14 includes, but is not limited to, a load bus 22, a movable contact 24, a fixed contact 26, and a line bus 28. The load bus 22 and movable contact 24 are in electrical communication. The contacts are also identified collectively as a "pair of contacts 29." The fixed contact 26 and the line bus 28 are in electrical communication. As is known, the circuit breaker 10, in an exemplary embodiment, includes multiple conductor assemblies 14 (three shown). Further, each conductor assembly 14 is disposed in a housing assembly channel 19 and substantially separated from the adjacent conductor assemblies 14. As used herein, the conductor assemblies 14 extend "longitudinally" relative to the housing assembly 12.

The operating mechanism 16 is operatively coupled to each movable contact 24 and is structured to move each movable contact 24 between an open, final tripped configuration, wherein each movable contact 24 is spaced from an associated fixed contact 26, and, a closed, second configuration, wherein each movable contact 24 is directly coupled to, and in electrical communication with, the associated fixed contact 26. The operating mechanism 16 is further structured to be in a "tripped" configuration. When the operating mechanism 16 is in the tripped configuration, the contacts are in the first configuration. Generally, a user manually moves the operating mechanism 16 between the first and second configuration. In response to an over current condition, the circuit breaker 10 will trip and the operating mechanism 16 is moved into the tripped configuration. As is further known, when the operating mechanism is in the tripped configuration, the operating mechanism 16 can also be moved into a "reset" configuration. The contacts 24, 26 stay in the first configuration while the operating mechanism 16 is in the reset configuration.

The operating mechanism 16 includes a number of biasing elements 30 (FIG. 1), such as but not limited to, a number of springs 32 (FIG. 1). The biasing elements 30 bias the operating mechanism 16, and therefore the contacts 24, 26, to the open, final tripped configuration. The operating mechanism 16 further includes a catch 36, discussed below, or similar device that maintains the operating mechanism 16, and therefore the contacts 24, 26, in the second configuration. The catch 36, or more generally the operating mechanism 16 is mechanically and operatively coupled to the trip unit assembly 40. As is known, the trip unit assembly 40 is structured to detect an over-current condition in the conductor assembly 14. The trip assembly 40 may include, but is not limited to, a thermal trip assembly (not shown) and/or a magnetic trip assembly (not shown). As is known, an over-current condition includes characteristics such as, but not limited to, increased heat and/or an increased magnetic field in the conductor assembly 14. Such characteristics are detected by the trip unit assembly 40 and generate a mechanical response. For example, a thermal trip assembly may include a bimetal that bends in response to increased heat. The mechanical response of the trip unit assembly 40 disengages, or decouples, the trip unit assembly 40 and the operating mechanism 16 catch 36. As the operating mechanism catch 36 is the construct maintaining the operating mechanism 16 in the second configuration, release of the operating mechanism catch 36 allows the biasing elements 30 to move the operating mechanism 16, and therefore the contacts 24, 26, to the open, first configuration.

The trip unit assembly 40 includes a trip bar 42. The trip bar 42 includes an elongated body 44. In an exemplary embodiment, the trip bar body 44 includes a generally radially extending latch surface 46. That is, the trip bar body 44 is rotatably coupled to the housing assembly 12 and is structured to rotate about the longitudinal axis (all elongated bodies have a longitudinal axis). The trip bar body latch surface 46 (also hereinafter "trip bar latching surface" 46) extends, generally radial relative to the trip bar body 44 axis of rotation.

Figure 6:
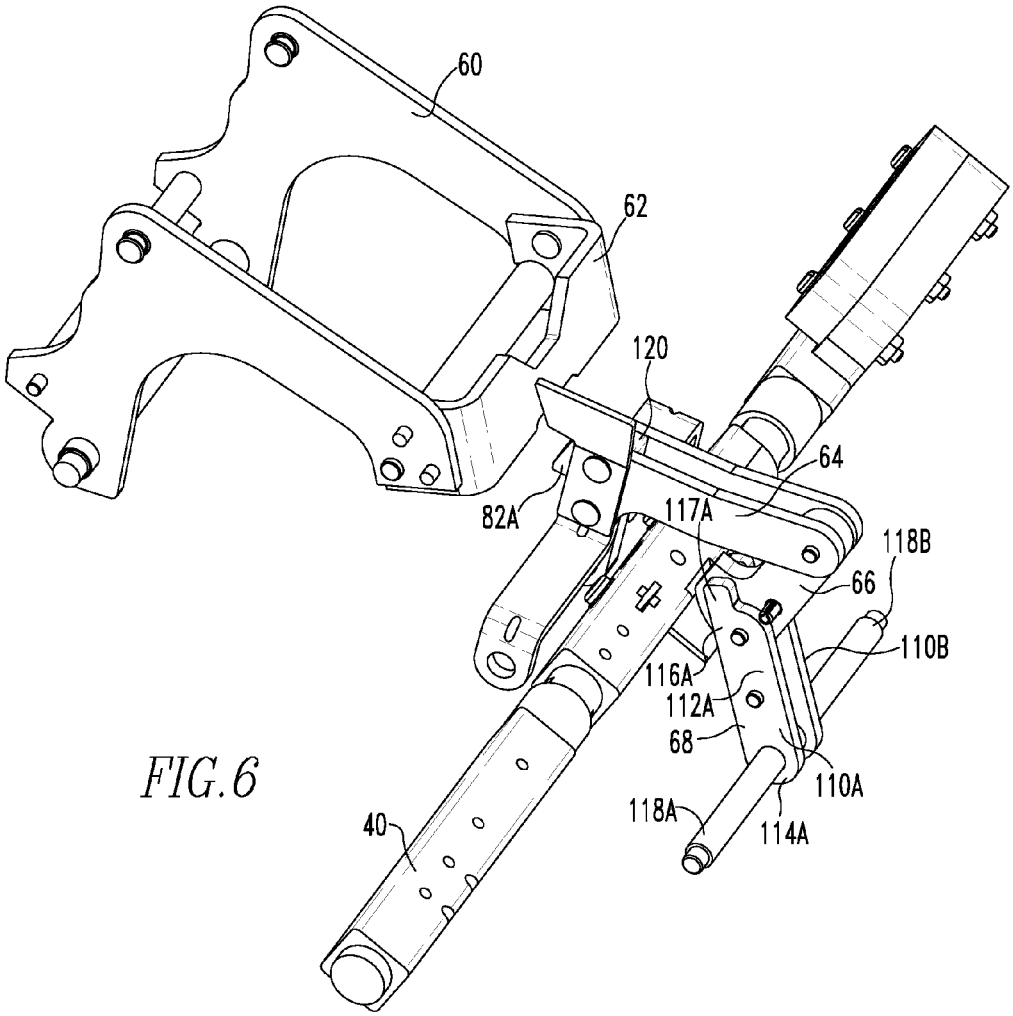
FIG. 6 is an isometric view of selected elements of the operating mechanism in a tripped configuration.
Figure 7:
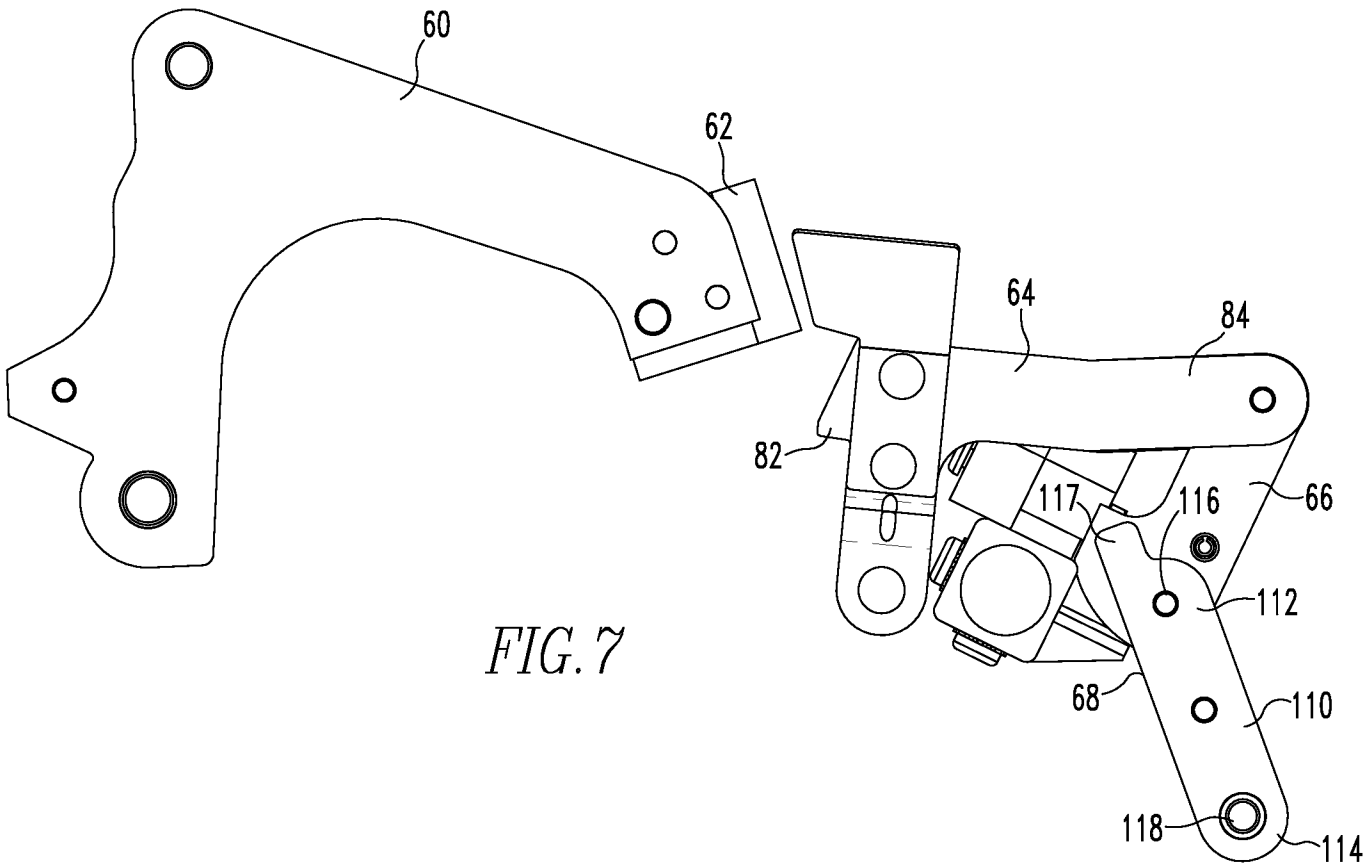
FIG. 7 is a side view of selected elements of the operating mechanism in a tripped configuration.

Generally, following an over current condition, the operating mechanism 16 moves between a second configuration and a final tripped configuration, which correspond to the contacts 24, 26 being in a second configuration and a first configuration. Further, as described below, the operating mechanism 16 also moves through an initial tripped configuration and a rebound configuration. As used herein, the "second configuration" and the "final tripped configuration" mean that the operating mechanism 16, and elements thereof as described below, are static and the elements of the operating mechanism 16 are motionless and free of momentum. Further, as used herein, the "initial tripped configuration" and the "rebound configuration" mean that the operating mechanism 16, and elements thereof as described below, are in motion and/or have momentum. It is further noted that in the initial tripped configuration and the final tripped configuration, the elements are substantially in the same positions, but in the initial tripped configuration the elements are moving and have momentum. As such, FIGS. 6 and 7 show the operating mechanism 16 in a "tripped" configuration which represents both the initial tripped configuration and the final tripped configuration.

Figure 4:
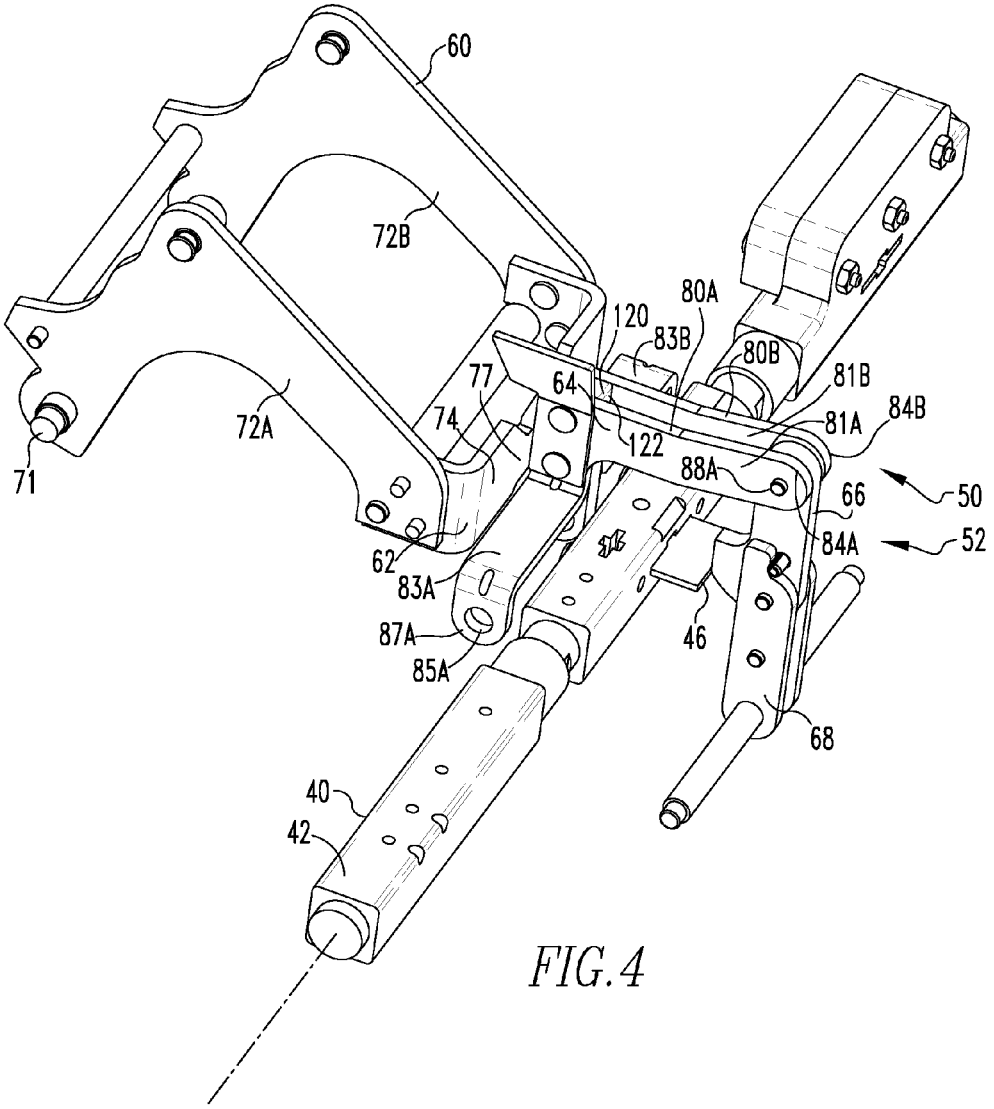
FIG. 4 is an isometric view of selected elements of the operating mechanism in a second configuration.

The operating mechanism 16 includes a number of linkage members 50. The operating mechanism linkage members 50 form a linkage assembly 52. As is known, elements of the operating mechanism 16 utilize a layered construction. That is, for example, and as shown in FIG. 4, in a construct having two elongated elements pivotally coupled to each other, a first "element" may include two substantially similar bodies that are disposed on either side of the second element. Such a configuration can be reversed; that is, there could be two bodies for the second element that sandwich the first element. Accordingly, as used herein, it is understood that a single linkage member, e.g., cradle latching member 64 (discussed below), may include a number of bodies that are collectively identified as a single linkage member. Further, in the Figures with an isometric view, an element including two bodies shall have those bodies identified with the letters "A" and "B." Conversely, in a Figure with a side view, those elements will be identified by a reference number only.

A number of operating mechanism 16 elements 30, including a number of linkage members 50, are not relevant to the present disclosure. As is known, these elements are structured to move the contacts 24, 26, charge (compress) the biasing elements 30, and perform other functions of the operating mechanism 16. As shown generally in FIGS. 4-9, this disclosure primarily addresses the following elements of an operating mechanism 16: a cradle 60, a cradle latch 62, a cradle latching member 64, a trip bar latch member 66, a support link member 68 and a handle 70 (FIG. 1). It is understood that the operating mechanism 16 includes additional elements.

As used herein, a "latch" or "latch member" is an element that is, in at least one configuration, under bias that will move from a selected position or configuration but for a restraint. It is noted that the combination of the selected position and bias are required for a "latch" or "latch member." That is, an element under bias, but not in a selected position or configuration is not a "latch." Further, the selected position or configuration is one from which the subsequent movement of the "latch" or "latch member" resulting from the bias is desired. Further, the selected position or configuration is the position or configuration wherein the "latch" or "latch member" is restrained by a "latching member" or "latching surface." As used herein, a "latching member" or "latching surface" is an element (or surface on an element) that restrains a "latch" or "latch member."

The cradle 60 is indirectly coupled to the contacts 24, 26. The cradle 60, in an exemplary embodiment, includes two generally planar bodies 72A, 72B. The cradle bodies 72A, 72B include rotatable coupling components 71 (as shown, an axle structured to be rotatably coupled to the housing assembly 12).

The handle 70 includes an elongated body 78 that is coupled, directly coupled or fixed, to the cradle 60. As is known, the handle 70 extends at least partially outside of the housing assembly 12. The handle 70 can be used to manually move the operating mechanism 16, and therefore the contacts 24, 26, between the second configuration and the open, final tripped configuration.

The cradle latch 62 is an elongated, generally planar body 74. As shown, the ends of the cradle latch body 74 are bent and coupled to the cradle bodies 72A, 72B. In this configuration, the cradle latch 62 extends laterally (relative to the housing assembly 12) between two cradle bodies 72A, 72B. Further, the circuit breaker 10 includes a stop surface 76 and, in an exemplary embodiment, the stop surface 76 is disposed on the cradle latch 62; hereinafter identified as cradle latch stop surface 77. As shown, and in an exemplary embodiment, the cradle latch stop surface 77 is on a planar surface disposed adjacent the cradle latching member 64.

Figure 8:
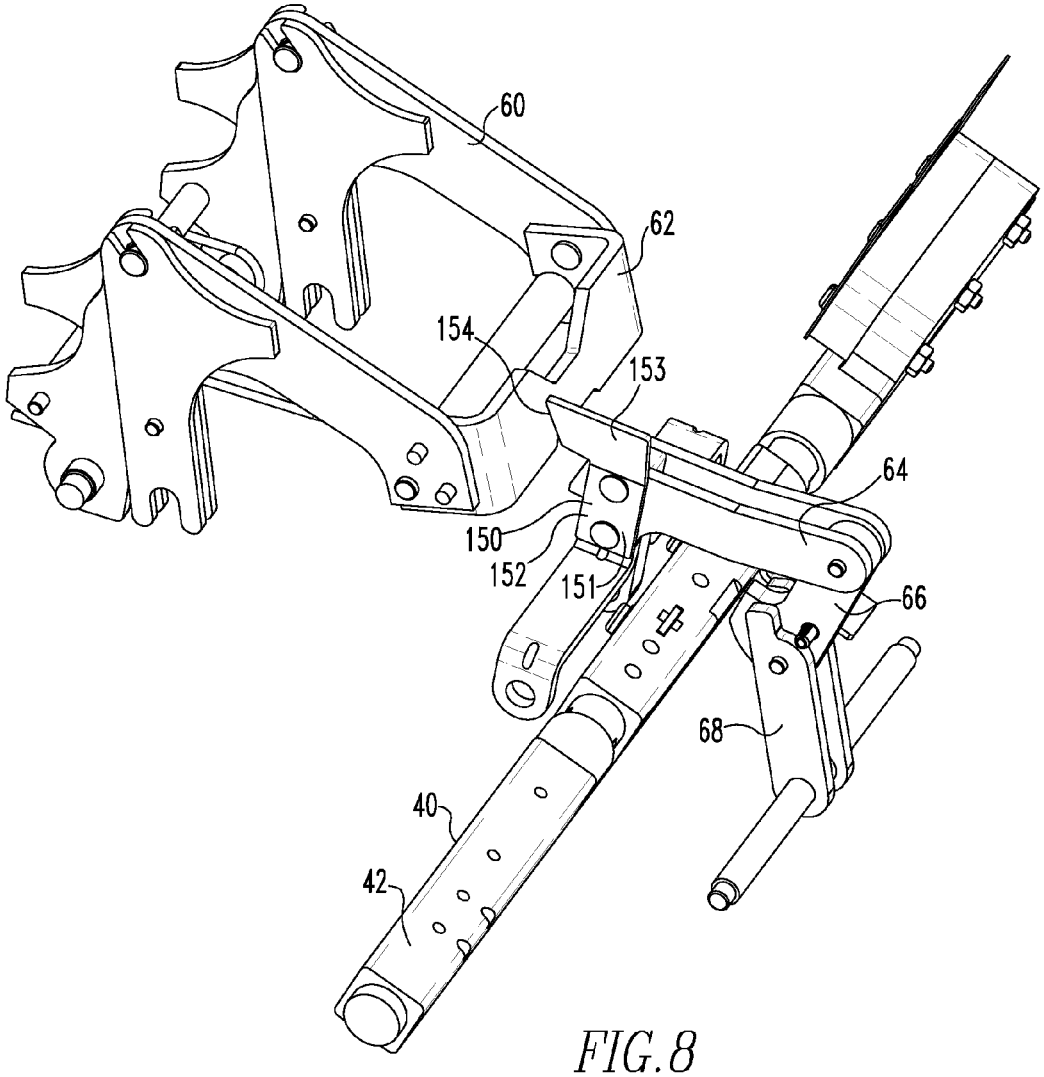
FIG. 8 is an isometric view of selected elements of the operating mechanism in a rebound configuration.

In an exemplary embodiment, the cradle latching member 64 includes two bodies 80A, 80B, as shown in FIGS. 4, 6, and 8, which are substantially mirror images of each other. As such, only one cradle latching member body 80A will be described. The reference numbers for the first cradle latching member body are followed by the letter "A." It is understood that the second cradle latching member body includes similar elements and may hereinafter be identified by the same name and a reference number followed by the letter "B." The cradle latching member body 80A includes a first elongated, generally planar portion 81A. The cradle latching member body planar portion 81A includes a first end 82A and a second end 84A. The cradle latching member body planar portion first end 82A includes a notch 86 (FIG. 5) structured to engage and/or be coupled to the cradle latch body 74. The cradle latching member body planar portion first end 82A also includes an elongated, generally planar lateral extension 83A that extends, generally, about ninety degrees relative to the plane of the cradle latching member body planar portion 81A. The cradle latching member body lateral extension 83A includes a distal end 85A. The cradle latching member body lateral extension distal end 85A is bent about ninety degrees relative to the plane the cradle latching member body lateral extension 83A. That is, the plane of the cradle latching member body lateral extension distal end 85A is generally parallel to the cradle latching member body planar portion 81. The cradle latching member body lateral extension distal end 85A includes a rotatable coupling component 87A. As shown as a non-limiting example, the rotatable coupling component 87A is a generally circular opening through which an axle (not shown) is disposed. The cradle latching member body planar portion second end 84A includes a rotatable coupling component 88A. As shown as a non-limiting example, the rotatable coupling component 88A is a generally circular opening through which an axle is disposed.

Figure 5:
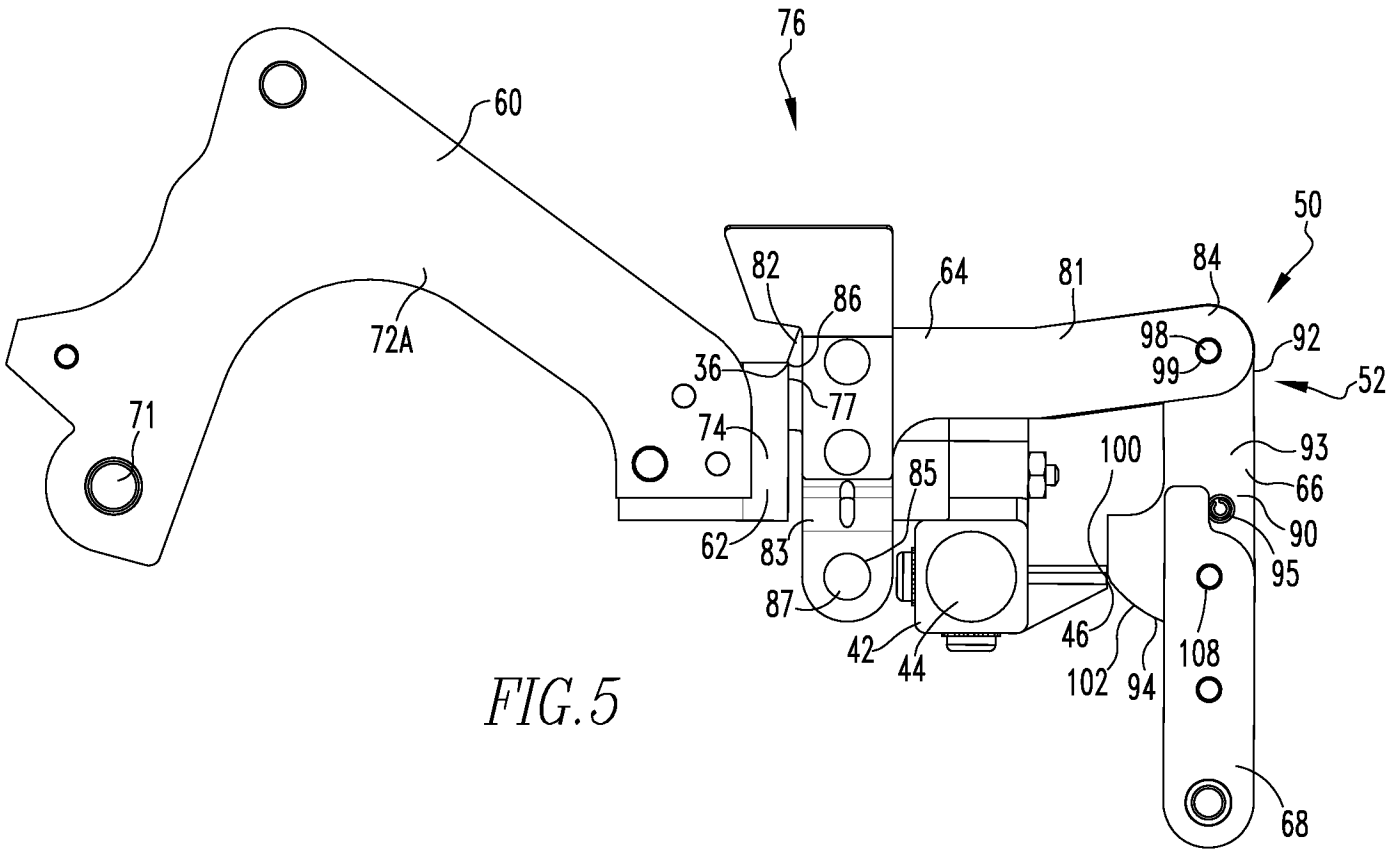
FIG. 5 is a side view of selected elements of the operating mechanism in a second configuration.

As shown best in FIGS. 6 and 7, the trip bar latch member 66 includes an elongated, generally planar body 90. The trip bar latch member body 90 includes a first end 92, a medial portion 93 and a second end 94. The trip bar latch member body first end 92 includes a rotatable coupling component 98, as shown an axle 99 that corresponds to the cradle latching member body planar portion second end coupling components 88A, 88B. The trip bar latch member body medial portion 93 includes a toggle lug 95. The trip bar latch member body second end 94 includes a latching surface 100 and a cam surface 102. As shown in FIG. 5, the trip bar latch member body second end latching surface 100 (also hereinafter "trip bar latch member latching surface" 100) extends longitudinally (relative to the trip bar latch member body 90) and generally in the plane of the trip bar latch member body 90. In an exemplary embodiment, the trip bar latch member body second end 94 is wider than the trip bar latch member body first end 92. In this configuration, the trip bar latch member latching surface 100 offset from the trip bar latch member body 90 longitudinal axis. As shown, the wide portion of the trip bar latch member body 90 also extends over the trip bar latch member body medial portion 93. The trip bar latch member body second end cam surface 102 is a generally arcuate, or curvilinear, surface defined by the edge surface at the trip bar latch member body second end 94. The trip bar latch member body second end 94 also includes a rotatable coupling component 108 (as shown an axle).

The support link member 68, in an exemplary embodiment, includes two elongated, generally planar bodies 110A, 110B which are substantially mirror images of each other. As such, only one support link member body 110A will be described. The reference numbers for the first support link member body are followed by the letter "A." It is understood that the second support link member body includes similar elements and may hereinafter be identified by the same name and a reference number followed by the letter "B." The support link member body 110A includes a first end 112A and a second end 114A. The support link member body first end 112A includes a rotatable coupling component 116A, as shown a generally circular opening that corresponds to trip bar latch member body second end rotatable coupling component 108. The support link member body first end 112A also includes a longitudinal extension 117A that extends longitudinally beyond the support link member body first end rotatable coupling 116A. The support link member body first end longitudinal extension 117A has a sufficient length so that, when the linkage assembly 52 is assembled, as discussed below, the support link member body first end longitudinal extension 117 will contact the trip bar latch member body medial portion toggle lug 95 when in the second configuration. The support link member body second end 114A also includes a rotatable coupling component 118A, as shown an axle.

As shown in FIG. 4, the operating mechanism 16 also includes a stop member support link 120. The stop member support link 120 includes an elongated, generally planar body 122.

Figure 9:
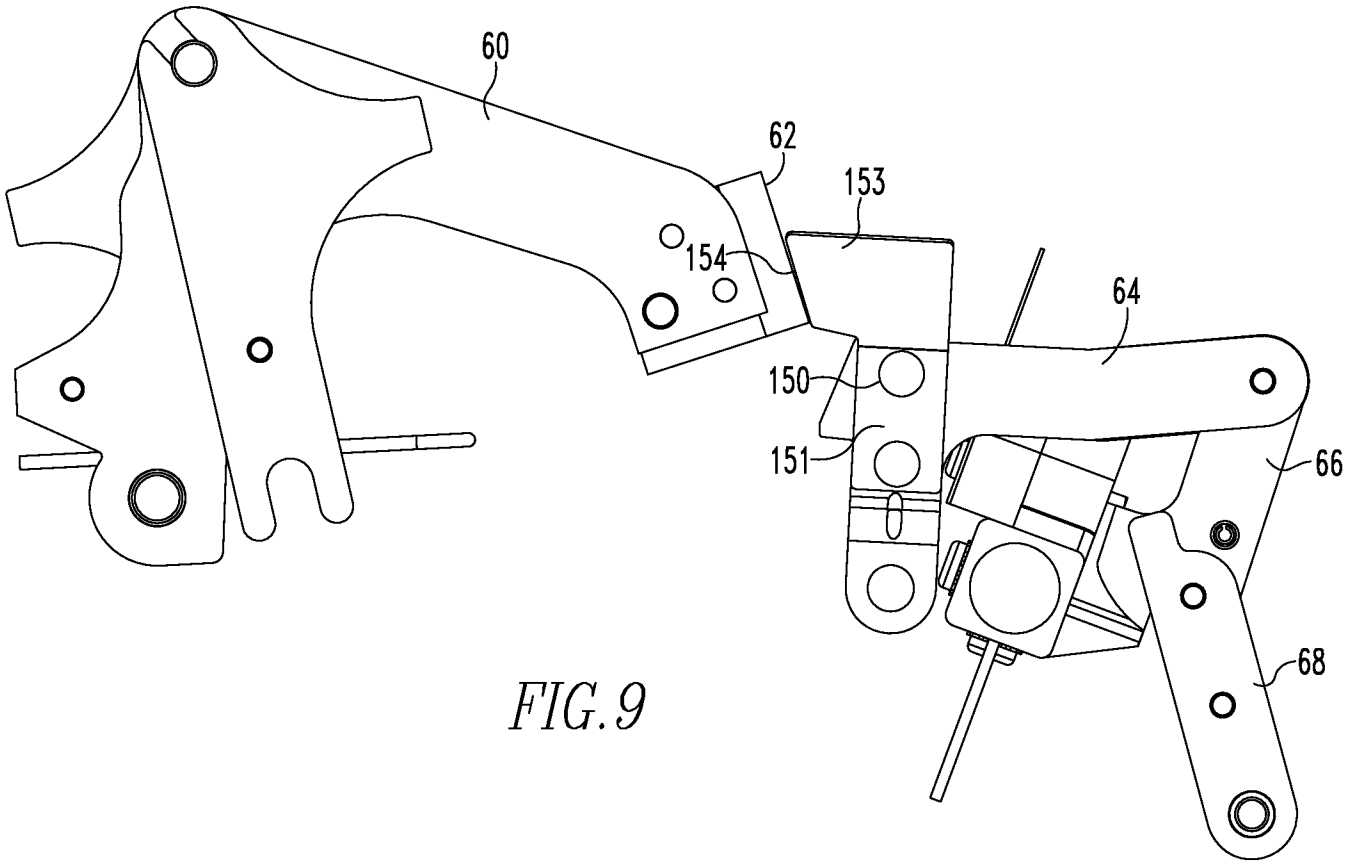
FIG. 9 is a side view of selected elements of the operating mechanism in a rebound configuration.

As shown in FIGS. 8 and 9, the operating mechanism 16 also includes a stop member 150. In an exemplary embodiment, the stop member 150 includes a generally planar L-shaped body 152. That is, the stop member body 152 includes long leg 151 and a short leg 153. The end edge surface 154 of the stop member body short leg 153 is, in an exemplary embodiment, angled.

As noted above, the operating mechanism linkage members 50 form a linkage assembly 52. In an exemplary embodiment, the linkage assembly 52 is assembled as follows. As shown in FIGS. 4-9, the cradle 60 is rotatably coupled to the housing assembly 12. As noted above, the ends of the cradle latch body 74 are bent and coupled to the cradle bodies 72A, 72B. In this configuration, the cradle latch 62 extends laterally (relative to the housing assembly 12) between two cradle bodies 72A, 72B.

The stop member support link 120 is disposed between the two cradle latching member bodies 80A, 80B at the cradle latching member body planar portion first end 82A, 82B. That is, the two cradle latching member bodies 80A, 80B are disposed in a mirror image configuration with the two cradle latching member body lateral extensions 83A, 83B extending in opposite directions. The stop member support link 120 is coupled, directly coupled, or fixed, to the cradle latching member body planar portion first end 82A, 82B. The two cradle latching member body lateral extension distal end rotatable coupling components 87A, 87B are rotatably coupled to the housing assembly 12.

The trip bar latch member 66 is rotatably coupled to the cradle latching member 64. In an exemplary embodiment, the trip bar latch member body first end rotatable coupling component 98 is rotatably coupled to the cradle latching member body planar portion second end coupling components 88A, 88B.

The trip bar latch member 66 is also rotatably coupled to the support link member 68. That is, the trip bar latch member body second end rotatable coupling component 108 is coupled to the support link member body first end rotatable coupling components 116A. In an exemplary embodiment, the trip bar latch member 66 is rotatably coupled to the support link member 68 as a toggle. That is, the trip bar latch member 66 is rotatably coupled to the support link member 68 in a manner that the two elements can only rotate in one direction from the second configuration (described below). This is accomplished by the support link member body first end longitudinal extension 117A extending to a location immediate adjacent, or in contact with, the trip bar latch member body medial portion toggle lug 95. The interface between the support link member body first end longitudinal extension 117A and the trip bar latch member body medial portion toggle lug 95 prevents the trip bar latch member 66 from rotating in one direction relative to the support link member 68. The support link member body second end rotatable coupling component 118A, 118B are rotatably coupled to the housing assembly 12.

The stop member 150 is coupled, directly coupled, or fixed to the cradle latching member 64 adjacent the stop member support link 120. That is, the stop member 150 is coupled, directly coupled, or fixed to the cradle latching member body planar portion first end 82A, 82B. In an exemplary embodiment, the stop member 150, and as shown the stop member body short leg 153, extends in a direction generally parallel to, and offset from, the longitudinal axis of the cradle latching member 64.

In the configuration described above, the cradle latching member 64, trip bar latch member 66, and support link member 68 can be disposed in a second configuration (described below) that resembles an inverted U-shape. The trip bar 42 extends laterally through the inverted U-shape assembly of the cradle latching member 64, trip bar latch member 66, and support link member 68. As noted above, the trip bar body 44 is rotatably coupled to the housing assembly 12 and is structured to rotate about the longitudinal axis. Further, in this configuration, the trip bar latch surface 46 is disposed adjacent to the trip bar latch member latching surface 100.

As noted above, the operating mechanism 16, and therefore the linkage assembly 52, moves through a number of configurations. These configurations will be described below as they occur sequentially during an over-current condition, i.e. as the circuit breaker 10 trips. It is further noted that each element that moves as the operating mechanism 16, and therefore the linkage assembly 52, moves from one configuration to another and travel over a "path." That is, as used herein, a "path" is the space an element occupies while moving from one position to another. Further, it is noted that the biasing elements 30 are operatively coupled to the linkage members 50, and, the operating mechanism 16 and trip assembly 40 are operatively coupled to each other.

As shown in FIGS. 4 and 5, the operating mechanism 16, and therefore the linkage assembly 52, start in the closed, second configuration. This configuration is substantially static. In this configuration, the cradle 60 is in its second configuration with the cradle latch 62 disposed closer to the trip bar 42 relative to when the cradle 60 is in its first configuration, described below. In the second configuration, the operating mechanism biasing elements 30 bias the cradle 60 to rotate counterclockwise as shown in FIGS. 4 and 5.

The cradle 60 is prevented from rotating by the cradle latching member 64. That is, when the cradle latching member 64 is in the second configuration, a portion of the cradle latch body 74 is disposed in the cradle latching member body planar portion first end notch 86. The cradle latching member 64 is maintained in the second configuration by the trip bar latch member 66, the support link member 68 and the trip bar 42 as described below. It is noted that, in the second configuration, the cradle latch stop surface 77 is not in the path of the stop member 150. Further, the longitudinal axis of the cradle latching member 64 passes through the cradle latching member 64.

In the second configuration, the longitudinal axis of the trip bar latch member 66 and the support link member 68 are substantially parallel. That is, the trip bar latch member 66 and the support link member 68 are disposed in the substantially straight configuration. In this configuration, the interface between the support link member body first end longitudinal extension 117A and the trip bar latch member body medial portion toggle lug 95 contact each other. In this configuration, the trip bar latch member body medial portion toggle lug 95 is disposed in the path of the support link member body first end longitudinal extension 117A if the support link member 68 moves clockwise as shown in FIGS. 4 and 5. As the support link member body first end longitudinal extension 117A cannot move through the trip bar latch member body medial portion toggle lug 95, the trip bar latch member 66 and the support link member 68 can only rotate in one direction relative to each other. Further, via a direct coupling or an indirect coupling, operating mechanism biasing elements 30 bias the trip bar latch member 66 and the support link member 68 toward the final tripped configuration, as described below.

The trip bar latch member 66 and the support link member 68 are maintained in the second configuration by the trip bar 42. That is, in the second configuration, the trip bar body latch surface 46 is engaged by the trip bar latch member latching surface 100 and the trip bar 42 is static; until an over-current condition occurs.

As noted above, when an over-current condition occurs, the trip unit assembly 40 disengages, or decouples, the trip unit assembly 40 and the operating mechanism catch 36. This is accomplished by rotating the trip bar 42. Following the rotation of the trip bar 42, the operating mechanism 16, and therefore the linkage assembly 52, move into the initial tripped configuration as follows. As the trip bar 42 rotates, the trip bar body latch surface 46 moves away from, i.e. disengages from, the trip bar latch member latching surface 100. Without the trip bar 42 to maintain the toggle assembly, i.e. the trip bar latch member 66 and the support link member 68, in the second configuration, the trip bar latch member 66 and the support link member 68 collapse, i.e. rotate relative to each other. As shown in FIGS. 6 and 7, this motion moves the trip bar latch member body second end 94 over the trip bar body latch surface 46. Stated alternately, the trip bar body latch surface 46 moves along the trip bar latch member body second end cam surface 102. Further, the trip bar latch member 66 rotates clockwise about the trip bar latch member body first end rotatable coupling component 98, as shown in FIGS. 6 and 7. This motion in turn moves the cradle latching member 64 generally horizontal from left to right, as can be shown comparing FIGS. 5 and 7. As the cradle latching member 64 moves away from the cradle latch 62, the cradle latch 62 is moved out of the cradle latching member body planar portion first end notch 86. With the cradle latch 62 no longer restrained, the cradle 60 rotates counterclockwise, as can be shown comparing FIGS. 5 and 7. This is the initial tripped configuration.

As the operating mechanism 16, and therefore the linkage assembly 52, enter the initial tripped configuration, various elements (not shown) of the operating mechanism 16 bind or contact other elements. The effect of such binding or contact is that the operating mechanism 16, and therefore the linkage assembly 52, cannot continue to move in the direction that the elements were previously moving. While some elements of the linkage assembly 52, such as but not limited to the cradle 60 and the cradle latch 62, substantially come to a stop, other elements of the linkage assembly 52, such as but not limited to the cradle latching member 64, trip bar latch member 66, support link member 68, and the trip bar 42 rebound. That is, momentum and elasticity of selected elements of the linkage assembly 52 cause the trip bar 42, the cradle latching member 64, trip bar latch member 66, support link member 68, and the trip bar 42 to rotate in a reverse direction (including but not limited to the trip bar 42) or move in reverse direction (including but not limited to the support link member 68). That is, various elements move over a reverse path compared to the motion associated with moving from the second configuration to the initial tripped configuration.

That is, the operating mechanism 16, and therefore the linkage assembly 52, move toward the rebound configuration. Generally, the operating mechanism 16, and therefore the linkage assembly 52, are substantially in the initial tripped configuration, as described above, but the direction of motion for the cradle latching member 64, trip bar latch member 66, and support link member 68 has reversed. This reverse motion, however, is arrested, or stopped, by the operating mechanism stop member 150. That is, as shown in FIG. 5, the cradle 60 and the cradle latch 62 are in their initial tripped configuration and stopped. The cradle latching member 64, trip bar latch member 66, and support link member 68, however, are still in motion, and as noted, a motion in the direction opposite the motions described above. Thus, the cradle latching member 64 is moving from the right to the left, the trip bar latch member 66 is rotating counter clockwise about the trip bar latch member body first end rotatable coupling component 98, and the support link member 68 is rotating clockwise about the support link member body second end rotatable coupling component 118A, as shown in FIG. 9. In the rebound configuration, the operating mechanism stop member 150, and in an exemplary embodiment, the stop member short leg end edge surface 154, contacts the cradle latch 62 at the cradle latch stop surface 77. That is, the cradle latch stop surface 77 is in the path of the operating mechanism stop member 150. It is noted that in this configuration, the longitudinal axis of the cradle latching member 64 does not pass through the cradle latch member 62. Thus, it is the offset of the stop member 150, and in an exemplary embodiment, the stop member short leg 153, that positions the stop member short leg end edge surface 154 adjacent the cradle latch stop surface 77.

Thus, the stop member 150, which is coupled to the cradle latching member 64 and moving therewith, is positioned to contact the a stop surface 76 when the linkage members 50 are in the rebound configuration. In an exemplary embodiment, the stop member 150 contacts the cradle latch stop surface 77. This contact substantially absorbs the momentum of the cradle latching member 64, trip bar latch member 66, and support link member 68 causing the reverse motion to substantially stop/be arrested.

Further, in the rebound configuration, the trip bar latch member 66 and support link member 68 are still in a substantially collapsed configuration, i.e. the longitudinal axes thereof are not substantially aligned. In this configuration, the trip bar latch member body second end cam surface 102 is disposed over the trip bar body latch surface 46. When the trip bar body latch surface 46 contacts the trip bar latch member body second end cam surface 102, this contact interferes, i.e. stops/arrests, the rotational motion of the trip bar 42.

With the reverse motion stopped, the operating mechanism biasing elements 30 bias the operating mechanism 16, and therefore the linkage assembly 52, to the final tripped configuration. That is, as the trip bar 42, the cradle latching member 64, trip bar latch member 66, and support link member 68 return to the first configuration, their momentum, as well as the momentum of other elements of the operating mechanism 16 are reduced relative to the momentum thereof when moving from the second configuration to the initial tripped configuration. Thus, when the various elements (not shown) of the operating mechanism 16 bind or contact other elements again, the cradle latching member 64, trip bar latch member 66, and support link member 68 remain in the final, first configuration. That is, the operating mechanism 16, and therefore the linkage assembly 52, is again static, this time in the open, final tripped configuration.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A linkage assembly for a circuit breaker wherein said circuit breaker includes a trip device with a trip bar, and an operating mechanism, said trip bar including a latching surface, said operating mechanism structured to move between an open, final tripped configuration and a closed, second configuration, said operating mechanism biased toward said first configuration, said trip bar structured to move between an open, first configuration and a closed, second configuration, said trip bar operatively coupled to said operating mechanism, wherein, when said operating mechanism and said trip bar are in their respective second configurations, said trip bar prevents said operating mechanism from moving to said first configuration, and, when trip bar is in said first configuration, said trip bar does not prevent said operating mechanism from moving to said final tripped configuration, said linkage assembly comprising:

a number of linkage members, said linkage members operatively coupled to each other and each movable between a second configuration, an initial tripped configuration, a rebound configuration, and a final tripped configuration, said linkage members biased to said final tripped configuration;

a stop member coupled to one said linkage member, said stop member moving with said associated linkage member, said stop member positioned to contact a stop surface when said linkage members are in said rebound configuration;

wherein contact between said stop member and said stop surface substantially arrests the motion of said linkage members;

said number of linkage members includes a cradle latch;

said stop surface disposed on said cradle latch;

said number of linkage members includes a cradle latching member and a trip bar latch member;

said stop member coupled to said cradle latching member;

said cradle latching member rotatably coupled to said trip bar latch member;

said trip bar latch member including a latch surface and a cam surface; and wherein when said trip bar latch member is in one of said rebound configuration or said final tripped configuration, said trip bar latch member cam surface is disposed in the path of said trip bar latching surface.

2. The linkage assembly of claim 1 wherein:

said cradle latch moves between a second configuration, an initial tripped configuration, a rebound configuration, and a final tripped configuration; and wherein, when said cradle latch is in said rebound configuration, said cradle latch stop surface is disposed in the path of said stop member, and, when said cradle latch member is in said second configuration, said cradle latch stop surface is not disposed in the path of said stop member.

3. The linkage assembly of claim 1 wherein:

said cradle latching member is an elongated member; and said stop member extends in a direction generally parallel to the longitudinal axis of said cradle latching member.

4. The linkage assembly of claim 3 wherein:

when said cradle latching member is in said second configuration, the longitudinal axis of said cradle latching member passes through said cradle latch;

when said cradle latching member is in said rebound configuration, the longitudinal axis of said cradle latching member does not pass through said cradle latch; and said stop member is offset from the longitudinal axis of said cradle latching member.

5. An operating mechanism for a circuit breaker wherein said circuit breaker includes number of pairs of contacts, and a trip unit assembly with a trip bar, said trip bar including a latching surface, said pairs of contacts structured to move between an open, first configuration and a closed, second configuration, said trip bar structured to move between an open, first configuration and a closed, second configuration, said trip bar operatively coupled to said operating mechanism, said operating mechanism comprising:

a number of biasing elements;

a number of linkage members, said linkage members operatively coupled to each other and each movable between a second configuration, an initial tripped configuration, a rebound configuration, and a final tripped configuration;

said biasing elements operatively coupled to said number of linkage members, wherein said number of linkage members are biased to said final, first configuration;

a stop member coupled to one said linkage member, said stop member moving with said associated linkage member, said stop member positioned to contact a stop surface when said linkage members are in said rebound configuration;

wherein contact between said stop member and said stop surface substantially arrests the motion of said linkage members;

said number of linkage members includes a cradle latch;

said stop surface disposed on said cradle latch;

said number of linkage members includes a cradle latching member and a trip bar latch member;

said stop member coupled to said cradle latching member;

said cradle latching member rotatably coupled to said trip bar latch member;

said trip bar latch member including a latch surface and a cam surface; and wherein when said trip bar latch member is in one of said rebound configuration or said final tripped configuration, said trip bar latch member cam surface is disposed in the path of said trip bar latching surface.

6. The operating mechanism of claim 5 wherein:

said cradle latch moves between a second configuration, an initial tripped configuration, a rebound configuration, and a final tripped configuration; and wherein, when said cradle latch is in said rebound configuration, said cradle latch stop surface is disposed in the path of said stop member, and, when said cradle latch is in said second configuration, said cradle latching member stop surface is not disposed in the path of said stop member.

7. The operating mechanism of claim 5 wherein:

said cradle latching member is an elongated member;

said stop member extends in a direction generally parallel to the longitudinal axis of said cradle latching member.

8. The operating mechanism of claim 7 wherein:

when said cradle latching member is in said second configuration, the longitudinal axis of said cradle latching member passes through said cradle latch;

when said cradle latching member is in said rebound configuration, the longitudinal axis of said cradle latching member does not pass through said cradle latch; and said stop member is offset from the longitudinal axis of said cradle latching member.

9. A circuit breaker comprising:

a housing assembly;

a trip unit assembly disposed in said housing assembly, said trip unit assembly including a trip bar;

said trip bar including a latching surface;

an operating mechanism disposed in said housing assembly, said operating mechanism including a number of biasing elements and a number of linkage members;

said linkage members operatively coupled to each other and each movable between a second configuration, an initial tripped configuration, a rebound configuration, and a final tripped configuration;

said biasing elements operatively coupled to said number of linkage members wherein said number of linkage members are biased to said final, first configuration;

said trip bar structured to move between an open, final tripped configuration and a closed, second configuration, said trip bar operatively coupled to said operating mechanism;

a stop member coupled to one said linkage member, said stop member moving with said associated linkage member, said stop member positioned to contact a stop surface when said linkage members are in said rebound configuration;

wherein contact between said stop member and said stop surface substantially arrests the motion of said linkage members;

said number of linkage members includes a cradle latch;

said stop surface disposed on said cradle latch;

said number of linkage members includes a cradle latching member and a trip bar latch member;

said stop member coupled to said cradle latching member;

said cradle latching member rotatably coupled to said trip bar latch member;

said trip bar latch member including a latch surface and a cam surface; and wherein when said trip bar latch member is in one of said rebound configuration or said final tripped configuration, said trip bar latch member cam surface is disposed in the path of said trip bar latching surface.

10. The circuit breaker of claim 9 wherein:

said cradle latch moves between a second configuration, an initial tripped configuration, a rebound configuration, and a final tripped configuration; and wherein, when said cradle latch is in said rebound configuration, said cradle latch stop surface is disposed in the path of said stop member, and, when said cradle latch is in said second configuration, said cradle latch stop surface is not disposed in the path of said stop member.

11. The circuit breaker of claim 9 wherein:

said cradle latching member is an elongated member; and said stop member extends in a direction generally parallel to the longitudinal axis of said cradle latching member.

12. The circuit breaker of claim 11 wherein:

when said cradle latching member is in said second configuration, the longitudinal axis of said cradle latching member passes through said cradle latch;

when said cradle latching member is in said rebound configuration, the longitudinal axis of said cradle latching member does not pass through said cradle latch; and said stop member is offset from the longitudinal axis of said cradle latching member.

* * * * *